US006806239B2

(12) United States Patent
Endou et al.

(10) Patent No.: US 6,806,239 B2
(45) Date of Patent: Oct. 19, 2004

(54) HIGH-LUBRICITY GREASE AND MODIFIER FOR LUBRICATING GREASE

(75) Inventors: Satoshi Endou, Aichi (JP); Rie Oguri, Aichi (JP); Mikio Yamamoto, Aichi (JP)

(73) Assignee: Hoshizaki Denki Co., Ltd., Aichi (JP)

( * ) Notice: Subject to any disclaimer, the term of this patent is extended or adjusted under 35 U.S.C. 154(b) by 35 days.

(21) Appl. No.: 10/173,122

(22) Filed: Jun. 18, 2002

(65) Prior Publication Data

US 2003/0008782 A1 Jan. 9, 2003

(30) Foreign Application Priority Data

Jul. 2, 2001 (JP) ..... P.2001-200889

(51) Int. Cl.[7] ..... C10M 157/00; C10M 119/00

(52) U.S. Cl. ..... 508/181; 508/291; 508/465; 508/482; 508/506; 508/551; 508/553; 508/579; 508/591

(58) Field of Search ..... 508/181

(56) References Cited

U.S. PATENT DOCUMENTS 4,252,658 A * 2/1981 Tasaka et al. ..... 508/131
4,787,993 A * 11/1988 Nagahiro ..... 508/155
4,840,739 A * 6/1989 Mori et al. ..... 508/136
5,415,791 A * 5/1995 Chou et al. ..... 508/103
5,789,354 A * 8/1998 Mikami et al. ..... 508/201
6,228,813 B1 * 5/2001 Yabe et al. ..... 508/106
6,413,915 B1 * 7/2002 Stehr ..... 508/181

FOREIGN PATENT DOCUMENTS

JP 61-12791 A 1/1986
JP 2001-164282 A * 6/2001

* cited by examiner

*Primary Examiner*—Ellen M. McAvoy
(74) *Attorney, Agent, or Firm*—Morgan, Lewis & Bockius LLP

(57) ABSTRACT

A lubricating-grease modifier for addition to and modification of a lubricating grease that is to be present in a driving mechanism of a machine or apparatus and lubricate a driving part of the driving mechanism, the modifier comprising a lubricating resin powder and a water-absorbing resin powder and a high-lubricity grease comprising a solid lubricant, the solid lubricant comprising at least one synthetic resin selected from the group consisting of polyamides, polyimides, high-density polyolefins and polyesters.

12 Claims, 2 Drawing Sheets

HIGH-LUBRICITY GREASE AND MODIFIER FOR LUBRICATING GREASE

FIELD OF THE INVENTION

The present invention relates to a modifier for lubricating greases and a high-lubricity grease comprising a grease containing a solid lubricant therein.

BACKGROUND OF THE INVENTION

A lubricating grease is a substance which, when introduced in a driving mechanism of a machine or apparatus, lubricates a driving part of the driving mechanism to thereby improve the durability of the components of the driving mechanism. Among greases is a high-lubricity grease comprising a grease containing a solid lubricant therein, such as the solid-lubricant-containing grease proposed in Japanese Patent Laid-Open No. 12791/1986. This kind of high-lubricity grease exerts excellent lubricity on high-hardness metallic parts made of a steel material. As the solid lubricant has hitherto been employed one or more substances comprising polytetrafluoroethylene as the main component.

SUMMARY OF THE INVENTION

Lubricating greases gradually alter during use. As the alteration proceeds to an excessive degree, the lubricity is considerably reduced or is lost, making the machine or apparatus unusable. Especially when the driving part of the driving mechanism of the machine or apparatus is disposed in an atmosphere rich in water or moisture, water is apt to come into the lubricating grease present in the driving part. In case where water has come into the lubricating grease, the water in the lubricating grease functions to gradually corrode or deteriorate the components of the driving part. During this corrosion or deterioration, the components of the driving part suffer lubrication failures, etc. Consequently, not only the driving part but also the driving mechanism has a considerably shortened life. As a result, it becomes necessary to replace the components of the driving part of the driving mechanism in an early stage.

On the other hand, when components of the driving part of a driving mechanism, e.g., the gears of a geared motor, have poor compatibility with each other, the driving part makes a strange noise such as, e.g., gear creaking to give a warning on an abnormal state thereof. Although the work may be required to replace the components of the driving part upon reception of the warning on an abnormal state, there frequently are cases where the components of this driving part have suffered little corrosion or deformation. In this case, the compatibility between the components of the driving part should be improved with a lubricating grease.

Accordingly, an aim of a first aspect of the invention is to eliminate those problems by modifying a lubricating grease. In particular, the aim is to provide a modifier for lubricating greases which is capable of attaining the desired modification.

The first aspect of the invention provides a lubricating-grease modifier for addition to and modification of a lubricating grease which is to be present in a driving mechanism of a machine or apparatus and lubricate a driving part of the driving mechanism, the modifier comprising a lubricating resin powder and a water-absorbing resin powder as effective ingredients.

In the lubricating-grease modifier of the first aspect of the invention the proportion by weight of the lubricating resin powder to the water-absorbing resin powder is preferably in the range of from 1:4 to 4:1. The lubricating resin powder as a component of the composition is preferably made of at least one member selected from the group consisting of polyethylene, polypropylene, nylons, polyesters, and polytetrafluoroethylene, and the water-absorbing resin powder is preferably made of at least one member selected from the group consisting of poly(acrylic acid salt) resins, poly (ethylene oxide) resins, vinyl acetate copolymer resins, and acrylic acid graft copolymer resins. The modifier can be used in such a manner that the modifier is added to and mixed with a lubricating grease beforehand, or that the modifier, according to need, is added to and mixed with a lubricating grease present in a driving mechanism of a machine or apparatus.

When the lubricating grease to which the first aspect of the invention is to be applied is used in a machine or apparatus having a driving mechanism whose driving part is placed in an atmosphere rich in water or moisture, then water is apt to come into the lubricating grease present in the driving part. In case where water has come into the lubricating grease, the water in the lubricating grease functions to gradually corrode or deteriorate the driving part. During this corrosion or deterioration, the driving part suffers lubrication failures, etc. As a result, not only the components of the driving part but also the driving mechanism has a considerably shortened life.

However, in the case where the lubricating grease contains the modifier of the first aspect of the invention, the water which is coming into the lubricating grease is taken up by the water-absorbing resin powder as a component of the modifier and is hence prevented from diffusing into the lubricating grease. Because of this, the lubricating grease exhibits its lubricity in the same state as the water-free state to lubricates the components of the driving part of the driving mechanism.

Consequently, by using the lubricating grease containing the modifier of the first aspect of the invention, the water which has come into the grease is prevented from corroding the components of the driving part. Since the components of the driving part are prevented from corroding and the driving part is hence prevented from suffering lubrication failures attributable to corrosion and from thus deteriorating, not only the life of the components of the driving part but also that of the driving mechanism can be greatly improved. As a result, the necessity of replacing the components of the driving part of the driving mechanism in an early state is eliminated.

On the other hand, in the case where components, e.g., gears, of the driving part of a driving mechanism have poor compatibility with each other, the driving part makes a strange noise such as, e.g., gear creaking to give a warning on an abnormal state thereof even when the components of the driving part are almost free from corrosion, deterioration, and deformation.

In that case, it is effective to use a grease containing the modifier incorporated therein beforehand as the lubricating grease to be applied to that driving part or to add the modifier composition, upon the noise production, to the lubricating grease present in the driving part. Particles of the lubricating resin powder and water-absorbing resin powder, in particular particles of the lubricating resin powder, are introduced between the components of the driving part to improve the compatibility between the components and thereby help the lubricating grease in lubricating the components. Consequently, in this case also, there is no need of replacing the components of the driving part of the driving mechanism in an early stage.

The high-lubricity grease proposed in the reference cited above, in which the solid lubricant consists mainly of polytetrafluoroethylene, has the following drawback. Since polytetrafluoroethylene is exceeding expensive as compared with the grease itself, the proposed high-lubricity grease is far more expensive than ordinary greases containing no solid lubricant (polytetrafluoroethylene).

Furthermore, not only high-lubricity greases but also ordinary greases have the property of absorbing water. Specifically, greases during use absorb water and hold it in an emulsified state. Because of this, in the high-lubricity greases containing polytetrafluoroethylene as a solid lubricant, the water held therein gradually reacts with the polytetrafluoroethylene with the aid of considerable frictional heat to generate hydrogen fluoride. The hydrogen fluoride generated acts on the high-hardness metallic parts being lubricated, e.g., a bearing made of stainless steel. The hydrogen fluoride destroys the passive-state surface film to accelerate corrosion of inner parts, and the resultant products of corrosion are released from the metallic parts and come into the grease. Consequently, the high-lubricity greases heretofore in use have the possibilities of corroding the parts being lubricated and of causing the parts to wear by the actin of the products of corrosion.

Accordingly, an aim of a second aspect of the invention is to eliminate those problems of high-lubricity greases heretofore in use. Namely, the aim is to provide a high-lubricity grease which does not corrode the parts being lubricated. Another aim of the second aspect of the invention is to enable a high-lubricity grease having such properties to be provided at a lower cost than this kind of high-lubricity greases heretofore in use.

The second aspect of the invention provides a high-lubricity grease which comprises a grease containing a solid lubricant therein, the solid lubricant comprising one or more synthetic resins selected from the group consisting of polyamides, polyimides, high-density polyolefins, and polyesters. Examples of the solid lubricant contained in the high-lubricity grease of the second aspect of the invention include synthetic resins such as aliphatic polyamides, e.g. nylons, aromatic polyamides, high-density polyethylene and polypropylene, and diallyl phthalate resins.

The high-lubricity grease of the second aspect of the invention contains one or more of those synthetic resins as the solid lubricant. The content of the synthetic resins is preferably from 1 to 50 parts by weight per 100 parts by eight of the grease.

The high-lubricity grease of the second aspect of the invention contains as a solid lubricant at least one synthetic resin selected from polyamides, polyimides, high-density polyolefins, polyesters, and the like. This solid lubricant, which comprises such synthetic resin(s), is inexpensive as compared with polytetrafluoroethylene, which is employed as a solid lubricant in the known high-lubricity greases. Furthermore, those synthetic resins for use as the solid lubricant in the second aspect of the invention have no or little reactivity with water even at high temperatures attributable to the frictional heat generating during use, and hence generate no harmful substance which may corrode the parts being lubricated. Therefore, the high-lubricity grease of the second aspect of the invention is a grease which neither corrodes the parts being lubricated nor causes the parts to wear by the action of products of corrosion. In addition, the high-lubricity grease can be provided at a low cost.

The modifier of the first aspect of the invention can be used for the grease of the second aspect of the invention can used.

DESCRIPTION OF REFERENCE NUMERALS AND SIGNS

Figure 1:
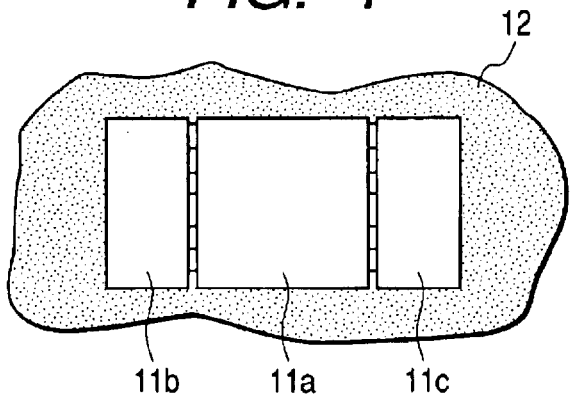
FIG. 1 is a diagrammatic view illustrating driving part components to which a lubricating grease has been applied.

11*a*–11*c* . . . components of driving part; 12 . . . lubricating grease; 13 . . . water; 14 . . . corroded/deteriorated area; 15*a* . . .water-absorbing resin powder not in water-holding state; 15*b* . . . water-absorbing resin powder in water-holding state; 16 . . . lubricating resin powder.

DETAILED DESCRIPTION OF THE INVENTION

[First Aspect of the Invention]

The modifier of the invention is one for application to a lubricating grease which is to be present in a driving mechanism of a machine or apparatus and lubricate the components of the driving part. Namely, the modifier modifies the lubricating grease when mixed therewith. This modifier comprises a lubricating resin powder and a water-absorbing resin powder as effective ingredients. The proportion by weight of the lubricating resin powder to the water-absorbing resin powder is preferably in the range of from 1:4 to 4:1.

As the lubricating resin powder to be contained in the modifier can be employed any of various resin powders known to aid the lubricity of lubricating greases. It is, however, preferred to use one or more of polyolefins such as, e.g., polyethylene and polypropylene, nylons, polyesters, and polytetrafluoroethylene.

As the water-absorbing resin powder to be contained in the modifier can be employed any of various resin powders known as water-absorbing resins. It is, however, important to employ a water-absorbing resin powder which neither alters in the lubricating grease nor releases water which has been absorbed therein into the lubricating grease. It is especially preferred to use one or more of poly(acrylic acid salt) resins, poly(ethylene oxide) resins, vinyl acetate copolymer resins, and acrylic acid graft copolymer resins.

Although the proportion by weight of the lubricating resin powder to water-absorbing resin powder as components of the modifier is preferably in the range of from 1:4 to 4:1, this proportion can be suitably changed according to the atmosphere in which the lubricating grease to be modified is used. For example, in the case where the lubricating grease is to be applied to a driving part into which water is highly apt to come, the water-absorbing resin powder can be used in a larger amount within that proportion range. In the case where the lubricating grease is to be applied to a driving part into which water is relatively less apt to come, the water-absorbing resin powder can be used in a smaller amount within that proportion range.

Examples of manners of use in which the modifier is applied to a lubricating grease include: a manner in which the modifier is added to and mixed with the lubricating grease beforehand; and a manner in which the modifier is added to and mixed with the lubricating grease present in a driving part according to need, e.g., at the time when the driving part begins to make a strange noise. Either of these manners of use can be employed. However, in the case where the modifier can be easily introduced into the driving part which is working or not working, the latter manner of use can be employed. The amount of the modifier to be mixed with the lubricating grease in either of these manners of use is preferably in the range of from 5 to 30% by weight based on the grease. As the amount of the modifier mixed increases, the viscosity of the lubricating grease gradually decreases.

FIGS. 1 to 4 are views diagrammatically illustrating the states in which the modifier functions. In the figures, symbols 11*a*, 11*b*, and 11*c* denote components of, e.g., a geared motor. Numeral 12 denotes a lubricating grease, 13 denotes water which has penetrated, and 14 denotes a corroded and/or deteriorated area (hereinafter referred to as corroded/deteriorated area 14) in the components. Furthermore, symbol 15*a* denotes a water-absorbing resin powder not in a water-holding state, 15*b* denotes the water-absorbing resin powder in a water-holding state, and 16 denotes a lubricating resin powder.

Figure 2A:
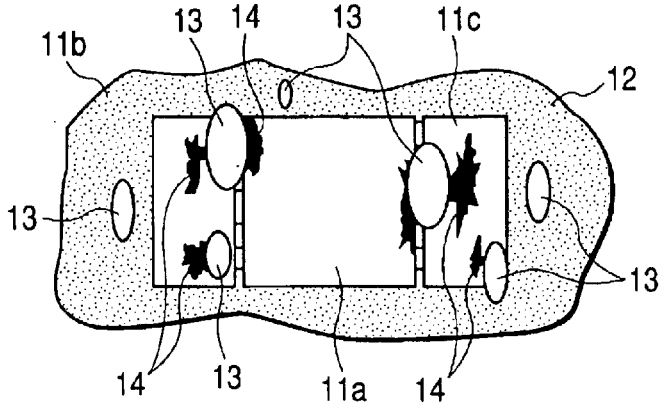
FIG. 2A is a diagrammatic view illustrating the greased components in which water has come into the lubricating grease.

FIG. 1 shows new components 11*a* to 11*c* of a driving part and a lubricating grease 12 applied thereto. When water 13 comes into the lubricating grease 12 in the driving part which is working in that state, then the water corrodes and deteriorates many areas in the components 11*a* to 11*c* to form many corroded/deteriorated areas 14 as shown in FIG. 2A. On the other hand, when the components 11*a* to 11*c* have poor compatibility with each other, a strong force is exerted between the components 11*a* to 11*c* to partly deteriorate the components 11*a* to 11*c* and thereby form many deteriorated areas 14 as shown in FIG. 2B.

Figure 3:
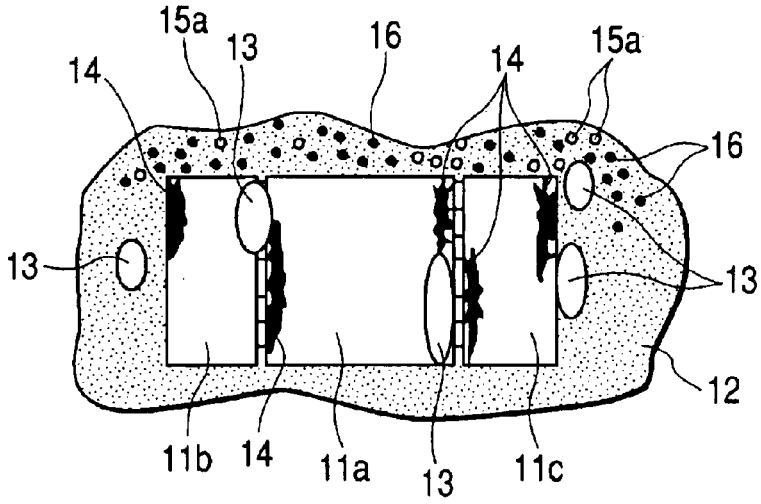
FIG. 3 is a diagrammatic view illustrating the greased components in which a modifier is diffusing into the lubricating grease.

In those cases, the driving part makes a strange noise, e.g., gear creaking, and the formation of those corroded/deteriorated areas 14 in the components 11*a* to 11*c* can be noticed due to the noise production. The modifier is hence added to the lubricating grease 12 present in the driving part. The modifier added to the lubricating grease 12 diffuses into the lubricating grease 12 due to the movement of the components which each is moving, as shown in FIG. 3. Finally, the modifier evenly mixes with the lubricating grease 12.

Figure 4:
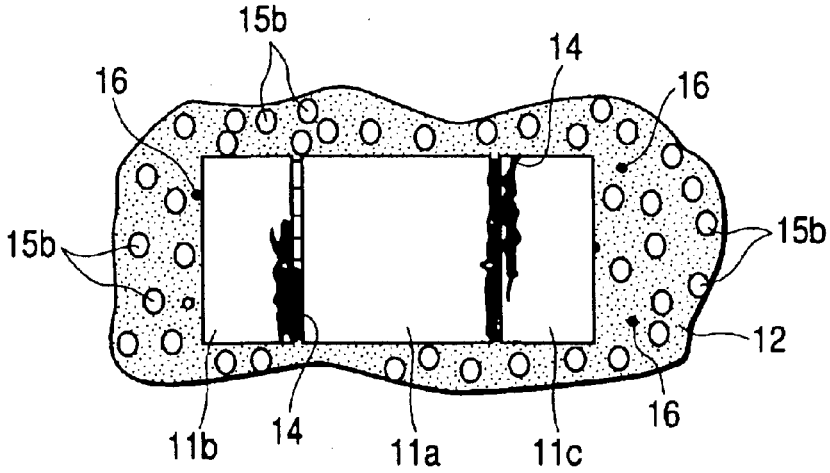
FIG. 4 is a diagrammatic view illustrating the greased components in which the water in the lubricating grease has been taken up by the water-absorbing resin powder.

In the case where the lubricating grease 12 with which the modifier has evenly mixed contains water 13 which has come thereinto, the water-absorbing powder 15*a* as a component of the modifier takes up the water 13 present in the lubricating grease 12. Thus, the powder 15*a* becomes a water-holding resin powder 15*b* as shown in FIG. 4, whereby the water 13 is inhibited from functioning to corrode/deteriorate the components 11*a* to 11*c*. Consequently, further formation of corroded/deteriorated areas 14 in the components 11*a* to 11*c* is prevented. In addition, the lubricating resin powder 16 as a component of the modifier functions as a lubricant aid to aid the lubrication of the components 11*a* to 11*c*.

Figure 2B:
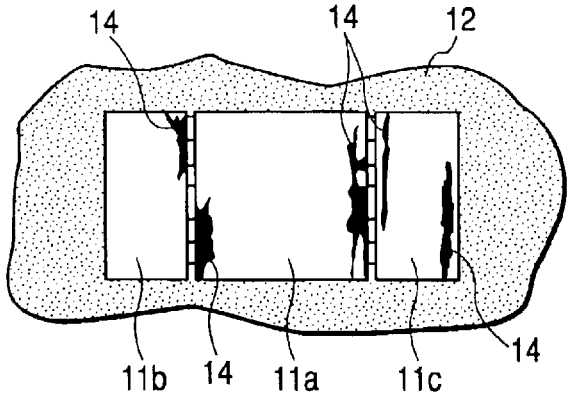
FIG. 2B is a diagrammatic view illustrating the greased components which have poor compatibility with each other.

In the case where the components 11*a* to 11*c* have poor compatibility with each other as shown in FIG. 2B, the modifier mixed with the lubricating grease 12 is interposed between the components 11*a* to 11*c* and compatibilizes the components 11*a* to 11*c* with each other to thereby eliminate the strong force exerting between the components 11*a* to 11*c*. Consequently, further formation of corroded/deteriorated areas 14 in the components 11*a* to 11*c* is prevented.

Those effects of the modifier can, of course, be produced even when the modifier is mixed beforehand with the grease 12. This manner of use is effective especially when it is difficult to add the modifier to the lubricating grease 12 present in a driving part which is working or not working or when the addition of the modifier thereto is improper.

[Second Aspect of the Invention]

The high-lubricity grease of the invention comprises a grease containing as a solid lubricant one or more of synthetic resins such as polyamides, polyimides, high-density polyolefins, and polyesters. In the high-lubricity grease of the invention, the grease used is not particularly limited and any of various greases heretofore in use prepared from various base oils can be employed. As the base oil for the grease can be employed a mineral oil or a synthetic oil such as a polyolefin oil.

In preparing a grease, additives having various properties are added to such a base oil. Examples of the additives include thickeners, oiliness improvers, rust preventives, antioxidants, and sticking agents. A thickener is an important additive for imparting a greasy consistency to a base oil, and examples thereof include metal soaps such as sodium soaps and lithium soaps, inorganic non-soap thickeners such as silica gel, and organic non-soap thickeners.

The solid lubricant employed in the high-lubricity grease of the invention comprises a finely particulate synthetic resin selected from polyamides, polyimides, high-density polyolefins, polyesters, and the like. For example, it is in the form of fine particles having an average particle diameter of about from several micrometers to tens of micrometers. Examples of the polyamides include aliphatic polyamides such as various nylons and aromatic polyamides. Examples of the high-density polyolefins include high-density polyethylene and polypropylene. Examples of the polyesters include diallyl phthalate resins. The solid lubricant may consist of one of these synthetic resins or two or more thereof. The content of the solid lubricant is preferably from 1 to 50 parts by weight per 100 parts by weight of the grease.

For preparing various embodiments of the high-lubricity grease of the invention, a suitable known method can be used. For example, use maybe made of a method in which any of kneading machines of various types is used to sufficiently knead a grease together with a finely particulate synthetic resin as a solid lubricant to evenly disperse the finely particulate synthetic resin as a solid lubricant into the grease. Specifically, this method may be conducted in such a manner that a finely particulate synthetic resin (solid lubricant)is added to a grease and these ingredients are simultaneously introduced into a kneading machine and sufficiently kneaded together. Alternatively, a finely particulate synthetic resin (solid lubricant) may be added to a grease which is being kneaded in a kneading machine and then sufficiently kneaded together with the grease.

The high-lubricity grease thus obtained contains the finely particulate synthetic resin, e.g., a polyamide, polyimide, high-density polyolefin, or polyester, as a solid lubricant evenly dispersed in the grease. This high-lubricity grease is suitable for use as, e. g., a lubricating grease for bearings made of stainless steel. This high-lubricity grease ennobles the bearings to retain their function satisfactorily. The high-lubricity grease does not generate any substance which may corrode the bearings. Consequently, the bearings are prevented not only from corroding but also from wearing by the action of products of bearing corrosion.

Still another advantage of the high-lubricity grease is that it can be provided at a lower cost than high-lubricity greases heretofore in use because the synthetic resin employed therein as a solid lubricant is far more inexpensive than polytetrafluoroethylene, which is employed in the high-lubricity greases heretofore in use.

The synthetic resins usable as the solid lubricant have the following merits. Aliphatic polyamides, high-density polyolefins, and the like are exceedingly inexpensive. Aromatic polyamides and polyimides are reduced in thermal deterioration and have excellent heat resistance. Furthermore, diallyl phthalate resins, which are thermoset resins, have excellent abrasion resistance under high-load highly frictional conditions. Because of these, the high-lubricity grease containing a synthetic resin such as an aliphatic polyamide or high-density polyolefin as a solid lubricant is advantageous in cost; the high-lubricity grease containing a synthetic resin such as an aromatic polyamide or polyimide as a solid lubricant is suitable for use in fields where the grease comes into a highly heated state; and the high-lubricity grease containing a diallyl phthalate resin as a solid lubricant is suitable for use in fields where the grease is used under severe conditions including a high load and high friction.

This application is based on Japanese Patent application JP 2001-200889, filed Jul. 2, 2001, and Japanese Patent application JP 11-350385, filed Dec. 9, 1999, the entire content of which is hereby incorporated by reference, the same as if set forth at length.

What is claimed is:

1. A lubricating-grease modifier for addition to and modification of a lubricating grease that is to be present in a driving mechanism of a machine or apparatus and lubricate a driving part of the driving mechanism, wherein the modifier comprises a lubricating resin powder and a water-absorbing resin powder, and wherein the water-absorbing resin powder is at least one member selected from the group consisting of poly (acrylic acid salt) resins, poly(ethylene oxide) resins, vinyl acetate copolymer resins, and acrylic acid graft copolymer resins.

2. A lubricating-grease modifier for addition to and modification of a lubricating grease that is to be present in a driving mechanism of a machine or apparatus and lubricate a driving part of the driving mechanism, wherein the modifier comprises a lubricating resin powder and a water-absorbing resin powder, and wherein the lubricating resin powder is at least one member selected from the group consisting of polyethylene, polypropylene, nylons, polyesters and polytetrafluoroethylene.

3. The lubricating-grease modifier according to claim 1, wherein the lubricating resin powder is at least one member selected from the group consisting of polyethylene, polypropylene, nylons, polyesters and polytetrafluoroethylene.

4. The lubricating-grease modifier according to claim 1 or claim 2, wherein a proportion by weight of the lubricating resin powder to the water-absorbing powder is in the range of from 1:4 to 4:1.

5. The lubricating-grease modifier according to claim 1 or claim 2, which is added to and mixed with the lubricating grease before use of the lubricating grease.

6. The lubricating-grease modifier according to claim 1 or claim 2, which is added to and mixed with the lubricating grease, wherein the lubricating grease is already present in the driving mechanism of a machine or apparatus.

7. A high-lubricity grease comprising:

a grease; and 1 to 50 parts by weight per 100 parts by weight of the grease of a solid lubricant comprising at least one synthetic resin selected from the group consisting of polyamides, polyimides, high-density polyolefins and polyesters;

wherein the solid lubricant is in the form of particles having an average diameter of about from several micrometers to tens of micrometers.

8. The high-lubricity grease according to claim 7, wherein the grease is prepared from a base oil selected from the group consisting of a mineral oil or a synthetic oil.

9. The high-lubricity grease according to claim 8, wherein the synthetic oil is a polyolefin oil.

10. The high-lubricity grease according to claim 7, further comprising at least one additive selected from the group consisting of a thickener, an oiliness improver, a rust preventative, an antioxidant and a sticking agent.

11. The high-lubricity grease according to claim 10, wherein the thickener is selected from the group consisting of a metal soap, an inorganic non-soap and an organic non-soap.

12. The high lubricity grease according to claim 7, further comprising a lubricating-grease modifier for addition to and modification of a lubricating grease that is to be present in a driving mechanism of a machine or apparatus and lubricate a driving part of the driving mechanism, wherein the modifier comprises a lubricating resin powder and a water-absorbing resin powder, and wherein the water-absorbing resin powder is at least one member selected from the group consisting of poly (acrylic acid salt) resins, poly(ethylene oxide) resins, vinyl acetate copolymer resins, and acrylic acid graft copolymer resins.

* * * * *